US012781630B2

(12) United States Patent
Lv

(10) Patent No.: US 12,781,630 B2
(45) Date of Patent: Nov. 3, 2026

(54) CONSTRUCTION METHOD AND SYSTEM FOR ROOF SEALING AND FOUNDATION STRENGTHENING OF CROSSING PROJECT IN HIGH-DENSITY URBAN AREA

(71) Applicant: University of Science and Technology Beijing, Beijing (CN)

(72) Inventor: Xiangfeng Lv, Beijing (CN)

(73) Assignee: University of Science and Technology Beijing, Beijing (CN)

( * ) Notice: Subject to any disclaimer, the term of this patent is extended or adjusted under 35 U.S.C. 154(b) by 64 days.

(21) Appl. No.: 19/072,480

(22) Filed: Mar. 6, 2025

(65) Prior Publication Data

US 2025/0290415 A1 Sep. 18, 2025

(30) Foreign Application Priority Data

Mar. 13, 2024 (CN) ..... 202410287436.7

(51) Int. Cl.
*E21D 9/00* (2006.01)
*E02D 3/12* (2006.01)

(52) U.S. Cl.
CPC ..... *E21D 9/001* (2013.01); *E02D 3/12* (2013.01)

(58) Field of Classification Search
CPC ..... E21D 9/001; E02D 3/12
See application file for complete search history.

(56) References Cited

U.S. PATENT DOCUMENTS 5,722,800 A * 3/1998 Esters ..... E02D 31/00 405/36
10,760,236 B2 * 9/2020 Eddie ..... G01N 33/24
2009/0304457 A1 * 12/2009 Shimada ..... E02D 3/12 405/269
2016/0312428 A1 * 10/2016 Ahlberg ..... B09B 1/006

FOREIGN PATENT DOCUMENTS

WO WO-2023173569 A1 * 9/2023 ..... E02D 17/20

* cited by examiner

*Primary Examiner* — Kyle Armstrong
(74) *Attorney, Agent, or Firm* — NKL Law; Allen Xue

(57) ABSTRACT

The present disclosure relates to a construction method and system for roof sealing and foundation strengthening of a crossing project in a high-density urban area. The method includes: penetrating drainage conduits into a first depth of a vertical position under a bottom of a solidification position layer on both sides of a construction site, and drawing a liquid level to a second depth under the bottom of the solidification position layer by using the drainage conduits; performing drilling from both sides of the construction site to a solidification position, and performing reinforcement treatment on the drilled hole to form a grouting hole; and penetrating grouting pipes from a wellhead into the grouting hole such that grouting positions of the grouting pipes are positioned at a location of a weakened layer above a tunnel, and a formation to complete construction of roof sealing and foundation strengthening.

10 Claims, 2 Drawing Sheets

CONSTRUCTION METHOD AND SYSTEM FOR ROOF SEALING AND FOUNDATION STRENGTHENING OF CROSSING PROJECT IN HIGH-DENSITY URBAN AREA

FIELD OF THE INVENTION

The present disclosure belongs to the technical field of construction of a crossing project in a high-density urban area, and in particular relates to a construction method and system for roof sealing and foundation strengthening of a crossing project in a high-density urban area.

BACKGROUND OF THE INVENTION

As the utilization of an aboveground space gradually saturates, the development and utilization of an underground space accelerate, and the development and utilization of an urban underground space in China is functionally dominated by underground traffic. The safety and efficiency of underground space development and utilization in high-density urban areas have become a new direction to be improved urgently.

An open-cut method has become a primary means for underground space development and utilization due to its simple construction technology, efficient construction efficiency, and safer acceptance conditions for a main structure, but its disadvantages such as long traffic blocking time, large influence of noise and vibration, and influence on stress changes of surrounding buildings make it unsuitable to be applied to construction in high-density urban areas.

Compared with the open-cut method, an undercutting method can overcome the disadvantages of large floor space during construction in high-density areas and the like while reducing the impact on surrounding construction facilities, but it is greatly affected by engineering geological and hydrogeological conditions, and at the same time, ground subsidence may cause danger in buildings around the high-density areas.

Therefore, in order to reduce the influence of urban construction on underground crossing projects in complex areas of construction of transportation facilities, reduce construction disturbances, and ensure the safety of underground facilities, it is urgent to improve a construction process for an urban underground space.

SUMMARY OF THE INVENTION

In order to solve the above problems in the prior art, the present disclosure provides a construction method and system for roof sealing and foundation strengthening of a crossing project in a high-density urban area, for solving the above problems existing in the prior art.

Provided is a construction method for roof sealing and foundation strengthening of a crossing project in a high-density urban area, including:

S1, penetrating drainage conduits into a first depth of a vertical position under a bottom of a solidification position layer on both sides of a construction site, and drawing a liquid level to a second depth under the bottom of the solidification position layer by using the drainage conduits, the second depth being about half of the first depth;

S2, performing drilling from both sides of the construction site to a solidification position, and performing reinforcement treatment on the drilled hole to form a grouting hole;

S3, penetrating grouting pipes from a wellhead into the grouting hole such that grouting positions of the grouting pipes are positioned at a location of a weakened layer above a tunnel;

S4, injecting a solidification liquid into the grouting pipes, and continuously injecting the solidification liquid into the solidification position under the action of gradient pressurization;

S5, injecting the solidification liquid into a formation through the grouting pipes, maintaining a pressure for a certain period of time to enable sufficient penetration of the solidification liquid with a gradient concentration, and stopping the injecting after a penetration depth of the solidification liquid reaches a maximum value; and

S6, recycling the remaining solidification liquid in the grouting pipes, and performing solidification for a period of time to complete construction of roof sealing and foundation strengthening.

According to the aspects and any possible implementation described above, further provided is an implementation, wherein the first depth is 2 m and the second depth is 1 m.

According to the aspects and any possible implementation described above, further provided is an implementation, wherein the weakened layer above the tunnel is located under the solidification position.

According to the aspects and any possible implementation described above, further provided is an implementation, wherein the method further includes the steps of thoroughly washing an adhesive material on inner walls of the grouting pipes with a washing liquid, and injecting a spacer liquid to space the walls of the grouting pipes from the solidification liquid between S3 and S4.

According to the aspects and any possible implementation described above, further provided is an implementation, wherein the gradient pressurization in S4 is carried out under a gradient grouting pressure which is related to a density of the solidification liquid, a gravitational acceleration, a distance from wellhead to a solidified layer, and a height of a target layer.

According to the aspects and any possible implementation described above, further provided is an implementation, wherein the maximum value of the penetration depth in S5 is related to an average flow rate of a grouting solidification liquid, a height of the target layer, a formation porosity and the grouting time.

According to the aspects and any possible implementation described above, further provided is an implementation, wherein a pumping pressure during continuously injecting the solidification liquid into the solidification position in S4 is greater than a pore pressure and at the same time is less than a breakdown pressure.

According to the aspects and any possible implementation described above, further provided is an implementation, wherein the pore pressure is related to the atmospheric pressure at the construction site, a density of an overlying rock mass on the solidified layer, a gravitational acceleration, a distance from a wellhead to a target layer, a density of a solidified target layer and a height of the target layer.

Also provided is a construction system for roof sealing and foundation strengthening of a crossing project in a high-density urban area, the system including:

two drainage conduits, a roof sealing and foundation strengthening platform, grouting pipes, and grouting apparatuses, wherein the two drainage conduits respectively penetrate into a first depth of a vertical position under a bottom of a solidification position layer on both sides of a construction site, and a liquid level is drawn to a second depth under the bottom of the solidification position layer through the two drainage conduits, the second depth being half of the first depth; and the two grouting pipes are respectively drilled from both sides of the two drainage conduits to a solidification position, and are each connected to a grouting apparatus, the solidification position being disposed above a weakened layer above the tunnel.

According to the aspects and any possible implementation described above, further provided is an implementation, wherein each grouting pipe is made of a flexible material.

The beneficial effects of the present disclosure

Compared with the prior art, the present disclosure has the following beneficial effects:

(1) The present disclosure provides a construction process for roof sealing and foundation strengthening of a crossing project in a high-density urban area. The construction process achieves safe construction of roof sealing and foundation strengthening in complex urban environments through ultra-short radius gradient grouting, forming "V", "W" and "7" type arrangements, saving energy and reducing consumption;

(2) The present disclosure provides a construction process for roof sealing and foundation strengthening of a crossing project in a high-density urban area. The roof sealing and foundation strengthening technology adopts in-situ grouting solidification, which not only achieves high-value harmless treatment of engineering solid waste, but also realizes green construction.

(3) The present disclosure provides a construction process for roof sealing and foundation strengthening of a crossing project in a high-density urban area. The construction process tends to be more intelligence, adopts manual operation, achieves precise positioning and solidification of equipment, has simple operation, and has the advantages of saving manpower, and improving the accuracy, construction efficiency and quality, etc.

(4) The present disclosure provides a construction process for roof sealing and foundation strengthening of a crossing project in a high-density urban area. The in-situ roof sealing and foundation strengthening technology can reduce the excavation amount of foundation pits and construction areas, directly improving economic benefits.

(5) The present disclosure provides a construction process for roof sealing and foundation strengthening of a crossing project in a high-density urban area. After roof sealing and foundation strengthening, the stability of the construction site is guaranteed, the safety of underground facilities is ensured, and the safety of the construction site is improved.

(6) The present disclosure provides a construction process for roof sealing and foundation strengthening of a crossing project in a high-density urban area. The influence of urban construction on underground crossing projects in complex areas of construction of transportation facilities is reduced, construction disturbances are reduced, and convenience is provided for the normal life of residents in high-density areas.

Figure 1:
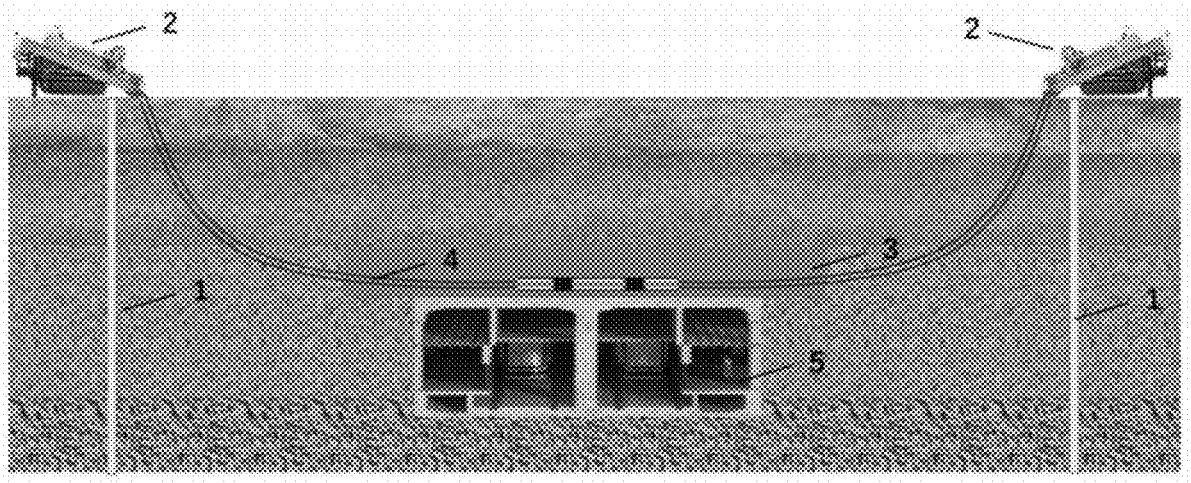
FIG. 1 is a schematic structural diagram of a system according to the present disclosure.
Figure 2:
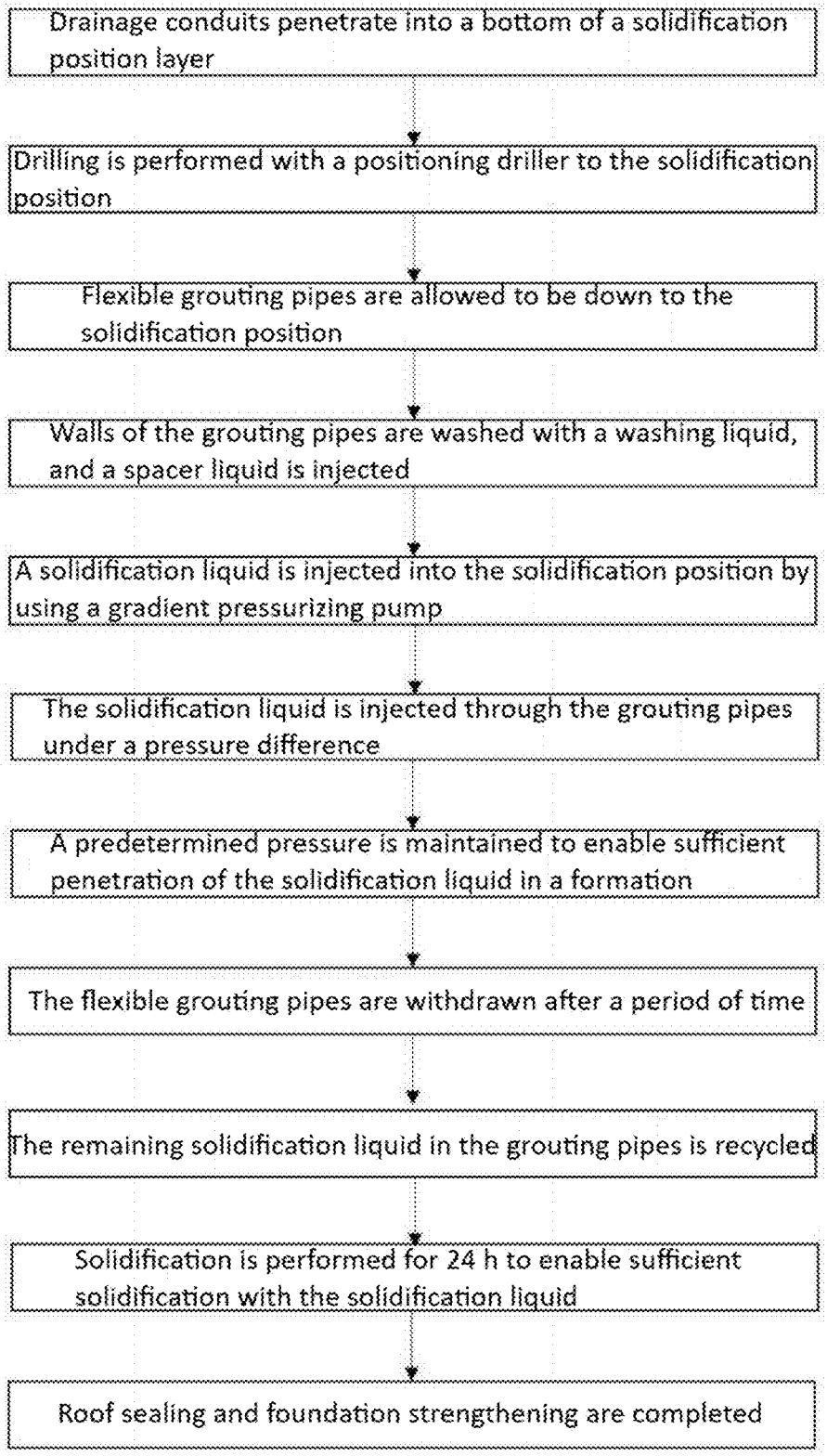
FIG. 2 is a flow diagram of a method according to the present disclosure.

In the drawings, 1, drainage conduit, 2, grouting apparatus, 3, roof sealing and foundation strengthening platform, 4, grouting pipe, and 5, proposed underground project.

DETAILED DESCRIPTION OF THE INVENTION

In order to better understand the technical solutions of the present disclosure, which includes but is not limited to the following detailed description, similar techniques and methods should be regarded as being within the scope of protection of the present disclosure. In order to make the technical problems to be solved by the present disclosure, technical solutions and advantages more clear, the detailed description will be made below with reference to the accompanying drawings and specific embodiments.

It should be clear that the described embodiments of the present disclosure are only some, but not all, embodiments of the present disclosure. Based on the embodiments in the present disclosure, all other embodiments obtained by those of ordinary skill in the art without making inventive step belong to the scope of protection of the present disclosure.

The terms used in the embodiments of the present disclosure are for the purpose of describing particular embodiments only and are not intended to be limiting of the present disclosure. As used in the embodiments of the present disclosure and the appended claims, the singular forms "a", "said" and "the" are intended to include the plural forms as well, unless the context clearly indicates otherwise.

As shown in FIG. 1, the present disclosure provides a construction system for roof sealing and foundation strengthening of a crossing project in a high-density urban area, including:

two drainage conduits 1, a roof sealing and foundation strengthening platform 3, grouting pipes 4, and grouting apparatuses 2, wherein the two drainage conduits 1 respectively penetrate into a first depth of a vertical position under a bottom of a solidification position layer on both sides of a construction site, and a liquid level is drawn to a second depth under the bottom of the solidification position layer through the two drainage conduits 1, the second depth being half of the first depth; and the two grouting pipes 4 are respectively drilled from both sides of the two drainage conduits 1 to a solidification position, and are each connected to a grouting apparatus 2, the solidification position being disposed above a weakened layer above the tunnel.

Each drainage conduit 1 is located on a left side of a corresponding proposed underground project 5, the grouting apparatuses 2 are located above ground levels of the proposed underground projects 5, and the roof sealing and foundation strengthening platform 3 is located above the proposed underground projects 5. The flexible grouting pipes 4 traverse the roof sealing and foundation strengthening platform 3, the weakened layer above the tunnel is located above the roof sealing and foundation strengthening platform 3, the solidification position is located above the weakened layer above the tunnel, and a solidified layer is a thickness of the solidification position.

As an embodiment disclosed of the present disclosure, the present disclosure also provides a construction method for roof sealing and foundation strengthening of a crossing project in a high-density urban area, including the following processes:

A1: drainage conduits 1 are penetrated into two meters of a vertical position under a bottom of a solidification position layer on both sides of a construction site by adopting a vertical pressurizing conduit technology, and a suction pump is connected to draw a liquid level to one meter under the bottom of the solidification position layer by using the drainage conduits 1 for reducing the moisture content at a solidification position, allowing a solidification agent to fully function;

A2: drilling is performed with a positioning driller from both sides to the solidification position, and conduit reinforcement treatment is conducted on the drilled hole to prevent a grouting hole from collapsing;

A3: flexible grouting pipes are penetrated into the grouting hole from both sides of a foundation pit such that grouting positions of the grouting pipes are positioned at a location of a weakened layer above a tunnel;

A4: mud blocks, mud cakes, etc. on inner walls of the grouting pipes are thoroughly washed with a washing liquid, and a spacer liquid is injected to space the walls of the grouting pipes from a solidification liquid to avoid blockage caused by adhesion to the walls of the grouting pipes;

A5: the solidification liquid is injected into the grouting pipes by using a ultra-short radius gradient pressurizing pump so that the grouting pipes are filled with the solidification liquid, and there is a certain remaining space, and a gradient grouting pressure needs to be calculated based on actual field conditions, and is calculated as follows:

$$P_d = \rho_s \cdot g(h_w + h_f)$$

where: $\rho_s$ is a density of the solidification liquid, g is a gravitational acceleration, $h_w$ is a distance from a wellhead to a target layer, and $h_f$ is a height of the target layer.

A6: the solidification liquid is continuously inject into the solidification position through the grouting pipes under the action of gradient pressurization, a pumping pressure is kept within a reasonable range, i.e., greater than a pore pressure and less than a breakdown pressure, a common breakdown pressure of a formation is taken to be 10 Mpa, and if it is a weak formation, the breakdown pressure should be taken to be 6-10 Mpa depending on the specific working conditions. The pore pressure of the formation is calculated as follows:

$$P_{hf} = P_0 + \rho_{up} \cdot g \cdot h_w + \rho_h \cdot g \cdot h_f$$

Where: $P_0$ is the local atmospheric pressure, $\rho_{up}$ is a density of an overlying rock mass on the solidified layer, and $\rho_h$ is a density of a solidified target layer.

A7: the solidification liquid is injected into the formation through the flexible grouting pipes under the action of a pressure difference, a pressure is maintained for a period of time to enable sufficient penetration of the solidification liquid with a gradient concentration, and a maximum penetration depth is calculated as follows:

$$L_s = \sqrt{\frac{Q_a \cdot t}{\pi \cdot h_f \cdot \varphi}}$$

where: $Q_a$ is an average flow rate of a grouting solidification liquid for gradient strengthening, φ is a formation porosity, and t is the grouting time.

After a penetration depth of the solidification liquid for gradient strengthening reaches a maximum value $L_{max}$, its penetration no longer increases with the increase of the penetration time, and its displacement is maintained at a steady value.

$$L_{max} = k \cdot \sqrt{t}$$

Where k is a constant related to soil and the properties of the solidification liquid, k takes a value of 0.5-2, and the value of k increases with the increase of a formation consolidation, and a specific value is determined according to the field working conditions.

At this time, the average penetration amount $Q_b$ is calculated as follows:

$$Q_b = 2\pi L_S \cdot h_f \cdot v$$

where v represents an average penetration velocity.

A8: the remaining solidification liquid in the grouting pipes is recycled, and solidification is performed for 24 h to complete construction of roof sealing and foundation strengthening, forming "V", "W" and "π" type grouting paths.

Embodiment

A construction system for roof sealing and foundation strengthening of a crossing project in a high-density urban area includes: drainage conduits 1, grouting apparatuses 2, a roof sealing and foundation strengthening platform 3, and flexible grouting pipes 4.

First, the drainage conduits 1 are penetrated into two meters of a vertical position under a bottom of a solidification position layer on both sides of a construction site by adopting a vertical pressurizing conduit technology, and a suction pump is connected to draw a liquid level to one meter under the bottom of the solidification position layer by using the drainage conduits for reducing the moisture content at a solidification position, allowing a solidification agent to fully function.

Drilling is performed with a positioning driller from both sides to the solidification position, and conduit reinforcement treatment is conducted on the drilled hole to prevent a grouting hole from collapsing.

The flexible grouting pipes are penetrated into the grouting hole from both sides such that grouting positions of the grouting pipes are positioned at a location of a weakened layer above a tunnel;

Mud blocks, mud cakes, etc. on inner walls of the grouting pipes are thoroughly washed with a washing liquid, and a spacer liquid is injected to space the walls of the grouting pipes from a solidification liquid to avoid blockage caused by adhesion to the walls of the grouting pipes.

The solidification liquid is injected into the grouting pipes by using a gradient pressurizing pump so that the grouting pipes are filled with the solidification liquid, and there is a certain remaining space.

The solidification liquid is continuously injected into the solidification position through the grouting pipes under the action of gradient pressurization, and a pumping pressure is kept within a reasonable range, i.e., greater than a pore pressure and less than a breakdown pressure.

The solidification liquid is injected into a formation through the grouting pipes under the action of a pressure difference, a pressure is maintained for a period of time to enable sufficient penetration of the solidification liquid with a gradient concentration, and after a penetration depth of the solidification liquid for gradient strengthening reaches a maximum value $L_{max}$, its penetration no longer increases with the increase of the penetration time, and its displacement is maintained at a steady value.

The remaining solidification liquid in the grouting pipes is recycled, and solidification is performed for 24 h to complete construction of roof sealing and foundation strengthening.

In conclusion, the method of the present disclosure adopts in-situ grouting solidification, which not only achieves high-value harmless treatment of engineering solid waste, but also tends to be more intelligence in construction, adopts manual operation, achieves precise positioning and solidification of equipment, and has simple operation, and has the advantages of saving manpower, and improving the accuracy, construction efficiency and quality, etc.

The foregoing description illustrates and describes several preferred embodiments of the present disclosure, however, as previously mentioned, it should be understood that the present disclosure is not limited to the forms disclosed herein, should not be regarded as an exclusion of other embodiments, but may be used in various other combinations, modifications and contexts, and can be modified within the scope of the inventive concept described herein by the above teachings or the technique or knowledge of the related art. Modifications and changes made by those skilled in the art without departing from the spirit and scope of the present disclosure fall within the scope of protection of the appended claims of the present disclosure.

The invention claimed is:

1. A construction method for roof sealing and foundation strengthening of a crossing project in a high-density urban area, including:

S1, penetrating drainage conduits into a first depth of a vertical position under a bottom of a solidification position layer on both sides of a construction site, and drawing a liquid level to a second depth under the bottom of the solidification position layer by using the drainage conduits, the second depth being about half of the first depth;

S2, performing drilling from both sides of the construction site to a solidification position, and performing reinforcement treatment on the drilled hole to form a grouting hole;

S3, penetrating grouting pipes from a wellhead into the grouting hole such that grouting positions of the grouting pipes are positioned at a location of a weakened layer above a tunnel;

S4, injecting a solidification liquid into the grouting pipes, and continuously injecting the solidification liquid into the solidification position under the action of gradient pressurization;

S5, injecting the solidification liquid into a formation through the grouting pipes, maintaining a pressure for a certain period of time to enable sufficient penetration of the solidification liquid with a gradient concentration, and stopping the injecting after a penetration depth of the solidification liquid reaches a maximum value; and S6, recycling the remaining solidification liquid in the grouting pipes, and performing solidification for a period of time to complete construction of roof sealing and foundation strengthening.

2. The construction method for roof sealing and foundation strengthening of a crossing project in a high-density urban area according to claim 1, wherein the first depth is 2 m and the second depth is 1 m.

3. The construction method for roof sealing and foundation strengthening of a crossing project in a high-density urban area according to claim 1, wherein the weakened layer above the tunnel is located under the solidification position.

4. The construction method for roof sealing and foundation strengthening of a crossing project in a high-density urban area according to claim 1, further including the steps of thoroughly washing an adhesive material on inner walls of the grouting pipes with a washing liquid, and injecting a spacer liquid to space the walls of the grouting pipes from the solidification liquid between S3 and S4.

5. The construction method for roof sealing and foundation strengthening of a crossing project in a high-density urban area according to claim 1, wherein the gradient pressurization in S4 is carried out under a gradient grouting pressure which is related to a density of the solidification liquid, a gravitational acceleration, a distance from the wellhead to the solidification position, and a height of a target layer.

6. The construction method for roof sealing and foundation strengthening of a crossing project in a high-density urban area according to claim 1, wherein the maximum value of the penetration depth in S5 is related to an average flow rate of a grouting solidification liquid, a height of the target layer, a formation porosity and the grouting time.

7. The construction method for roof sealing and foundation strengthening of a crossing project in a high-density urban area according to claim 1, wherein a pumping pressure during continuously injecting the solidification liquid into the solidification position in S4 is greater than a pore pressure and at the same time is less than a breakdown pressure.

8. The construction method for roof sealing and foundation strengthening of a crossing project in a high-density urban area according to claim 7, wherein the pore pressure is related to the atmospheric pressure at the construction site, a density of an overlying rock mass on the solidified layer, a gravitational acceleration, a distance from a wellhead to a target layer, a density of a solidified target layer and a height of the target layer.

9. A construction system for roof sealing and foundation strengthening of a crossing project in a high-density urban area, configured to implement the method according to claim 1, the system including:

two drainage conduits, a roof sealing and foundation strengthening platform, grouting pipes, and grouting apparatuses, wherein the two drainage conduits respectively penetrate into a first depth of a vertical position under a bottom of a solidification position layer on both sides of a construction site, and a liquid level is drawn to a second depth under the bottom of the solidification position layer through the two drainage conduits, the second depth being half of the first depth; and the two grouting pipes are respectively drilled from both sides of the two drainage conduits to a solidification position, and are each connected to a grouting apparatus, the solidification position being disposed above a weakened layer above the tunnel.

10. The construction system for roof sealing and foundation strengthening of a crossing project in a high-density urban area according to claim 9, wherein each grouting pipe is made of a flexible material.

* * * * *